US009126328B2

(12) United States Patent
Brandeis

(10) Patent No.: US 9,126,328 B2
(45) Date of Patent: Sep. 8, 2015

(54) TOOL HOLDER UNIT

(76) Inventor: Zeev Brandeis, Rosh Haayin (IL)

( * ) Notice: Subject to any disclaimer, the term of this patent is extended or adjusted under 35 U.S.C. 154(b) by 1998 days.

(21) Appl. No.: 10/547,791

(22) PCT Filed: Mar. 3, 2004

(86) PCT No.: PCT/IL2004/000207

§ 371 (c)(1),
(2), (4) Date: May 31, 2006

(87) PCT Pub. No.: WO2004/077974

PCT Pub. Date: Sep. 16, 2004

(65) Prior Publication Data

US 2006/0261116 A1 Nov. 23, 2006

Related U.S. Application Data

(60) Provisional application No. 60/450,647, filed on Mar. 3, 2003.

(51) Int. Cl.

| | |
|---|---|
| ***B25H 3/02*** | (2006.01) |
| ***A45F 5/02*** | (2006.01) |
| ***B25H 3/00*** | (2006.01) |

(52) U.S. Cl.

CPC .. *B25H 3/02* (2013.01); *A45F 5/02* (2013.01); *A45F 5/021* (2013.01); *B25H 3/006* (2013.01); *A45F 2005/025* (2013.01); *A45F 2200/0575* (2013.01)

(58) Field of Classification Search

CPC ... A45F 5/02; A45F 5/021; A45F 2200/0575; A45F 2205/025; B25H 3/02; B25H 3/006; Y10S 224/904

USPC ..... 224/660, 666, 671, 904

See application file for complete search history.

(56) References Cited

U.S. PATENT DOCUMENTS

| | | | | | |
|---|---|---|---|---|---|
| 1,625,920 | A | * | 4/1927 | Thurman | 224/241 |
| 3,915,361 | A | * | 10/1975 | Perkins | 224/666 |
| 4,106,679 | A | * | 8/1978 | Hillinger | 224/197 |
| D263,519 | S | | 3/1982 | Ader | |
| 4,358,036 | A | | 11/1982 | Maltais | |
| 4,588,116 | A | | 5/1986 | Litman | |
| 4,986,459 | A | * | 1/1991 | Yarbrough, Jr. | 224/661 |
| 5,195,667 | A | * | 3/1993 | Gallant | 224/197 |
| 5,201,445 | A | * | 4/1993 | Axelman | 224/197 |
| 5,240,156 | A | | 8/1993 | Sicotte et al. | |
| 5,341,975 | A | | 8/1994 | Marinescu | |
| 5,540,368 | A | * | 7/1996 | Oliva | 224/271 |
| 5,544,794 | A | * | 8/1996 | Nichols | 224/667 |
| 5,875,944 | A | * | 3/1999 | Beletsky | 224/198 |
| 5,884,876 | A | * | 3/1999 | Axford | 248/48.2 |
| 5,915,610 | A | * | 6/1999 | Russell | 224/673 |
| 6,041,444 | A | * | 3/2000 | McKinney | 2/310 |

(Continued)

*Primary Examiner* — Justin Larson
*Assistant Examiner* — Peter Helvey
(74) *Attorney, Agent, or Firm* — Edward Langer Adv. & Patent Attorney

(57) ABSTRACT

A tool holder unit for attachment to a user's belt comprising an ergonomically-shaped base; an ergonomically-shaped front section attached at its top end to the ergonomically-shaped base, the ergonomically-shaped front section having means for insertion of at least one of a tool and tool accessories; and means for securing a user's belt between the ergonomically-shaped base and the ergonomically-shaped front section, such that the tool holder unit does not become displaced from the user's belt due to body motion by the user.

4 Claims, 11 Drawing Sheets

(56) References Cited

U.S. PATENT DOCUMENTS

| | | | | |
|---|---|---|---|---|
| 6,062,449 | A * | 5/2000 | Kahn | 224/268 |
| 6,089,432 | A * | 7/2000 | Gage et al. | 224/587 |
| 6,119,909 | A | 9/2000 | Dancyger | |
| 6,209,766 | B1 | 4/2001 | Kwon | |
| 6,402,111 | B1 * | 6/2002 | Stewart et al. | 248/317 |
| 6,443,342 | B1 * | 9/2002 | Kahn | 224/268 |
| 6,454,147 | B1 * | 9/2002 | Marks | 224/268 |
| 6,508,390 | B1 * | 1/2003 | Karpati | 224/270 |
| RE38,035 | E * | 3/2003 | Kahn | 224/268 |
| 6,651,855 | B1 * | 11/2003 | Flynn | 224/251 |
| 6,659,317 | B2 * | 12/2003 | Borson | 224/183 |
| 6,679,404 | B2 * | 1/2004 | Brandt | 224/247 |
| 6,915,900 | B2 * | 7/2005 | Chen | 206/350 |
| 7,175,061 | B2 * | 2/2007 | Dohn | 224/673 |
| 7,258,259 | B1 * | 8/2007 | Owens | 224/193 |
| 7,617,960 | B2 * | 11/2009 | Clark | 227/156 |
| 7,658,307 | B2 * | 2/2010 | Skupin | 224/681 |
| 8,025,193 | B1 * | 9/2011 | Gornall, Jr. | 224/268 |
| 2002/0153394 | A1 * | 10/2002 | Borson | 224/183 |
| 2003/0019896 | A1 * | 1/2003 | Karpati | 224/270 |
| 2003/0160075 | A1 * | 8/2003 | Musarella et al. | 224/269 |
| 2005/0127121 | A1 * | 6/2005 | Wells | 224/193 |
| 2007/0235491 | A1 * | 10/2007 | Harris | 224/671 |

* cited by examiner

TOOL HOLDER UNIT

CROSS-REFERENCES TO RELATED APPLICATIONS

This application is a national stage entry of PCT/IL04/00207, filed Mar. 3, 2004, which claims priority from Provisional Application 60/450,647, filed Mar. 3, 2003.

FIELD OF THE INVENTION

The present invention relates generally to tool holders, and more specifically, to tool holder units for attachment to a user's belt.

BACKGROUND OF THE INVENTION

A workman's ability to access tools while working on a job is a known problem. In this text, the word "user" defines a workman, maintenance man, etc. as one who uses a tool to accomplish construction, assembly, disassembly, crafts or repair tasks and the like.

Numerous solutions to the problem of tool accessibility have been suggested by prior art devices. In some of these solutions, a belt is provided with a set configuration of tool compartments which the user wears over his existing belt and which cannot be arranged as the user would prefer. The compartments for specific tools are set in a specific configuration which may not be the configuration desirable for the user. Certain jobs require the use of certain tools preferentially or exclusively over others. Additionally, if the user does not want to carry his full set of tools with him, he must remove them from the belt and store them elsewhere, later returning them to their appropriate compartment on the belt. It may be that the tools needed for a specific job are located at an inconvenient place on the belt and are not easily accessible to the user.

Alternatively, the prior art shows individual tool compartment units which can be threaded on to the user's belt in a variety of arrangements. While this allows the user to preferentially arrange the tools on the belt, and choose those necessary for a specific job, it necessitates the user opening his belt and removing it from the belt loops, both to attach the units and to remove them.

Another proposed solution to this problem is a clip-on device to be placed on the user's existing belt. This allows the user to attach and detach the unit without removing the belt. This is well known for cellular phone users. However, often the clip is easily displaced from the belt when the user changes position, e.g., sits down, as upward force on the clip holder causes it to rise and disengage from the belt. This problem is accentuated by the fact that many tools are wider and longer than a cellular phone causing more displacement problems due to the user's movements.

Prior art U.S. Pat. No. 5,240,156 to Sicotte et al. discloses a modular component system which provides a specially formed belt for attaching various compartments. However, it is not suited to tool use, as the attachments are formed by the use of a provided belt covered in loops to which the attachments units stick by way of hooks, such as those provided by VELCRO™. This would not be suitable for use with tools which can be heavy, such as cordless drills, mallets etc., as the attachment units could easily become detached from the belt, causing a safety risk to the user and damage to the tools. Additionally, the attachment units can only be used with the specific belt provided with the attachments, thus limiting the user.

Thus, it would be desirable to provide a tool holder which can be attached and detached without the removal of the user's belt, would allow the user to choose which tool units to attach to the belt and in what arrangement, and which would sit securely on the user's belt without fear of displacement due to the user's movements.

SUMMARY OF THE INVENTION

Accordingly, it is a broad object of the present invention to overcome the problems of the prior art and provide a series of tool holder units which can be attached singly or in multiples to a user's belt in any desired arrangement, without the necessity of undoing the belt and which can be secured to the belt in a way which does not allow displacement.

In accordance with a preferred embodiment of the present invention, there is provided a tool holder unit for attachment to a user's belt, the tool holder unit comprising:

- an ergonomically-shaped base;
- an ergonomically-shaped front section attached at its top end to the ergonomically-shaped base, the ergonomically-shaped front section having means for insertion of at least one of a tool and tool accessories; and
- means for securing a user's belt between the ergonomically-shaped base and the ergonomically-shaped front section, such that the tool holder unit does not become displaced from the user's belt due to body motion by the user.

The tool holder unit of the present invention may be adapted to hold a variety of tools and/or accessories as necessary for the user. The tool holder unit is comprised of an ergonomically-shaped base which clips behind the user's belt, and a similarly ergonomically-shaped front section which sits in front of the user's belt. The ergonomic curve of the base, which is matched to the ergonomic curve of the front section, prevents displacement.

Additionally, the unit is further secured by a device for attaching the holder to the belt. This securing device provides ease of mounting and dismounting from the user's belt without need for opening the belt or removing the belt from the belt loops of the pants, while at the same time assuring that the holder is securely attached and will not accidentally become knocked off the user's belt. This securing device can take the form of a channel in which the belt sits, or teeth which snag under the user's belt. These two features prevent the unit from being knocked off the user's belt when the user changes positions, e.g. when the user sits down.

The front section of the tool holder unit is provided with holder means for holding or containing a tool or tools or accessories. A series of different adaptations is envisioned providing the user with the ability to select the necessary holder units and easily switch between various tool holder units according to the needs of the job. This modularity provides the user with the ability to carry only those tools which he needs and not carry a tool belt full of attachments and tools which he does not need at the time.

Those units which are not in use may be stored with the tools in them for later use. At least one hole is provided in the base of the unit to allow the holder unit, with or without the tool, to be hung from a typical peg board, such as those known for use in storing tools, such that it is conveniently available for immediate use.

Various tool holder units can be provided for containing different types of tools and accessories, the following list not being exclusive.

In one embodiment of the present invention, a unit is provided in which the front section has a holder for a hammer and a tape measure. The holder for the hammer consists of a ring extending from the lower side of the front section of the holder and having formed therein a semicircular opening for inserting a handle of a hammer, a mallet or similarly shaped tool. A slot for inserting the clip of a standard tape measure device is included above the hammer holder for the convenience of the user.

In another embodiment of the present invention, the unit is provided with a hook extending outward from the front section, which can be useful in holding a variety of tools and accessories, including a drill. The hook may be provided with a flexible strap for closing around the tool being held by the hook for further safety. Additionally the strap can prevent the hook from accidentally catching on obstacles, such as clothing, by mistake. When not in use, the strap can be attached to the front section so it is held securely in place and does not get in the way of the user.

In yet another embodiment, there is provided a holder unit for shears or clippers, in which there is attached to the front section a pocket for holding them or similar tools. The pocket is generally scissors-shaped and may be provided with at least one flange, preferably made of rubber, extending interior to the pocket for snagging the inserted tool such that the tool does not fall out when the user changes positions, e.g., bends over. In a preferred embodiment of the invention, the pocket is constructed of one piece, but it may be provided in other forms, such as separate straps, or have at least one opening in the middle. The pocket is made of any suitable material, such as rubber, plastic, and the like.

In a further embodiment of the present invention, there is provided a water-proof container for storage of items which are susceptible to damage by water, e.g., a cellular phone, a camera, and a PDA. This can be helpful both for the workman in an outdoor situation where rain may occur, or on jobs where water lines are involved, and also in other work situations in close proximity to water. The container is provided with a secured latch so as to prevent accidental opening. Additionally, the container opens to an approximately 60° angle so as to prevent the contents of the container from accidentally spilling when opened.

In yet a further embodiment of the invention, there is provided a tool holder unit for a cordless tool, which provides for its use by either right or left-handed users. In this embodiment, the front section of the tool holder unit has a lower end extension in the form of an open loop for inserting the cordless tool. Additionally, the front section is formed with a hole for rotatably attaching an arm ending in a cuff for holding the handle of the cordless tool. The hook may be provided with a mechanism for securing the handle in place in the form of a sliding closure or a flexible strap. The arm ending in a cuff may be supplied in either a right- or left-hand configuration for insertion into the hole in the front section.

In still another embodiment of the invention, the rotatable arm is provided with an S-shaped piece at the end of the arm such that a left- and right-handed solution is provided by rotating the arm to extend either to the left or right side of the tool holder unit and using whichever of the curves of the "S" is open upward to hold the handle of the cordless tool.

Alternatively, the rotatably attached arm is formed without a cuff and a U-shaped attachment is provided which is attachable to the rotatably attached arm in a sliding fashion, providing alternate sites of attachment so as to be adjustable to right- or left-handed users. In this embodiment, a flexible strap is attached to the U-shaped piece to secure the handle of the cordless tool in place.

In yet another embodiment of the invention, the cordless tool is seated in a pocket formed by a cover attached to the front section of the tool holder unit and provided with two V-shaped slots formed at the points of attachment of the cover at the open top end. The cordless tool is inserted into the pocket while the handle of the cordless tool extends out through either of the V-shaped slots, depending on the user's right- or left-handed orientation. Optionally, the cover is provided with an attachable pouch for containing drill bits or the like.

In still a further embodiment of the invention, a tool holder unit is provided with a pouch attached to the front section for holding small accessories such as the user may need, including drill bits, nails, screws, arts and crafts type items, and the like. Preferably, the pouch is made of plastic, although any suitable material may be used.

In a further embodiment of the invention, there is provided a tool holder unit with a pouch containing several compartments for insertion of small tools such as screwdrivers, arts and crafts tools, pens and pencils, and the like.

Additional features and advantages of the invention will become apparent from the following drawings and description.

BRIEF DESCRIPTION OF THE DRAWINGS

For a better understanding of the invention with regard to the embodiments thereof, reference is made to the accompanying drawings, not to scale, in which like numerals designate corresponding sections or elements throughout, and in which.

DETAILED DESCRIPTION OF THE DRAWINGS

Figure 1:
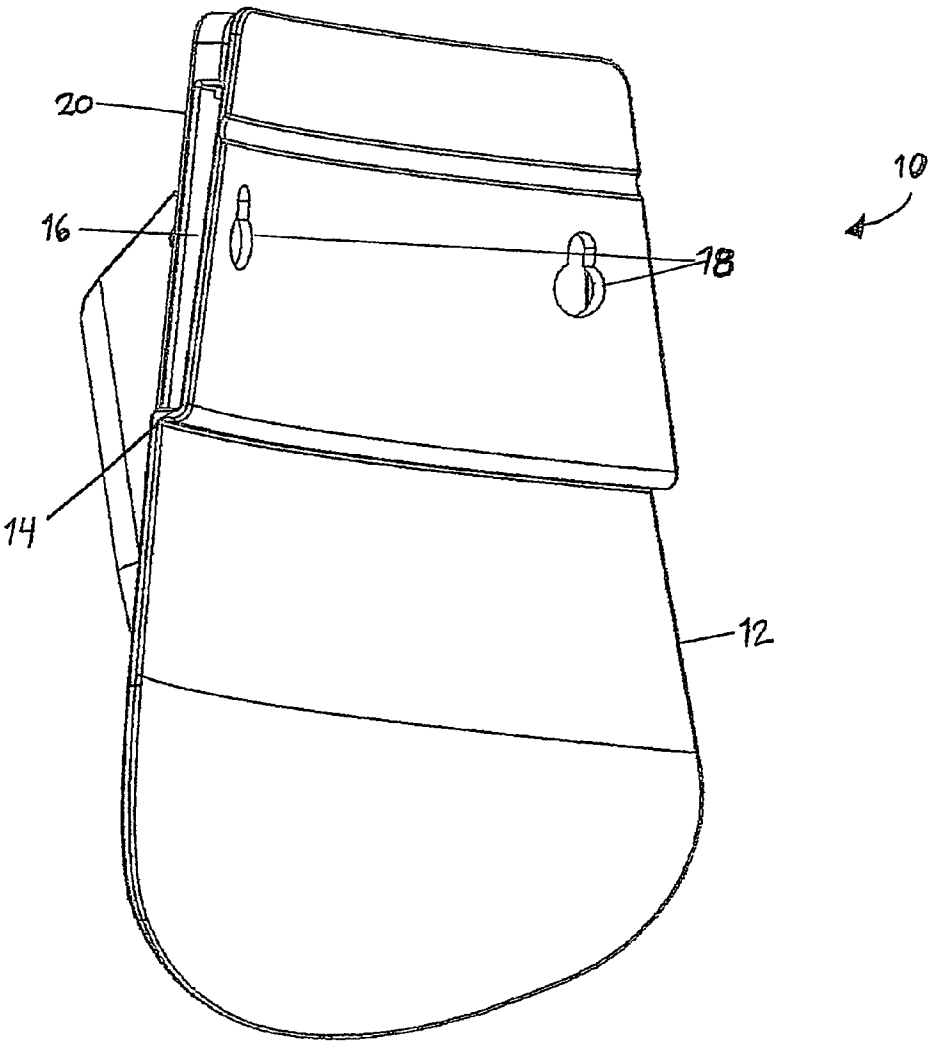
FIG. 1 is a perspective view of the back of the base of a tool holder unit in accordance with the present invention.

Referring now to FIG. 1, there is seen the tool holder unit 10 drawn as seen from the back of base 12. Base 12 is disposed in proximity to a user's body and is formed with step 14 for securing the user's belt (not shown). Base 12, together with front section 20, forms channel 16. Base 12 is attached at its top end 15 to front section 20. The user's belt sits in channel 16, and is prevented from displacement from upward pressure by step 14; and from downward pressure by top end 15 which serves as a spacer between base 12 and front section 12. Base 12 is provided with an ergonomic curve so as to closely match the user's body shape and further prevent the unit from jutting out and thereby catching and causing displacement. Holes 18 are provided for hanging the unit on a peg board or the like when not in use. In an alternative embodiment of the invention (not shown), instead of step 14 and channel 16 for securing the belt, base 12 is provided at its middle with small, teeth-like grips for snagging the bottom edge of the user's belt and preventing upward displacement.

Figure 2:
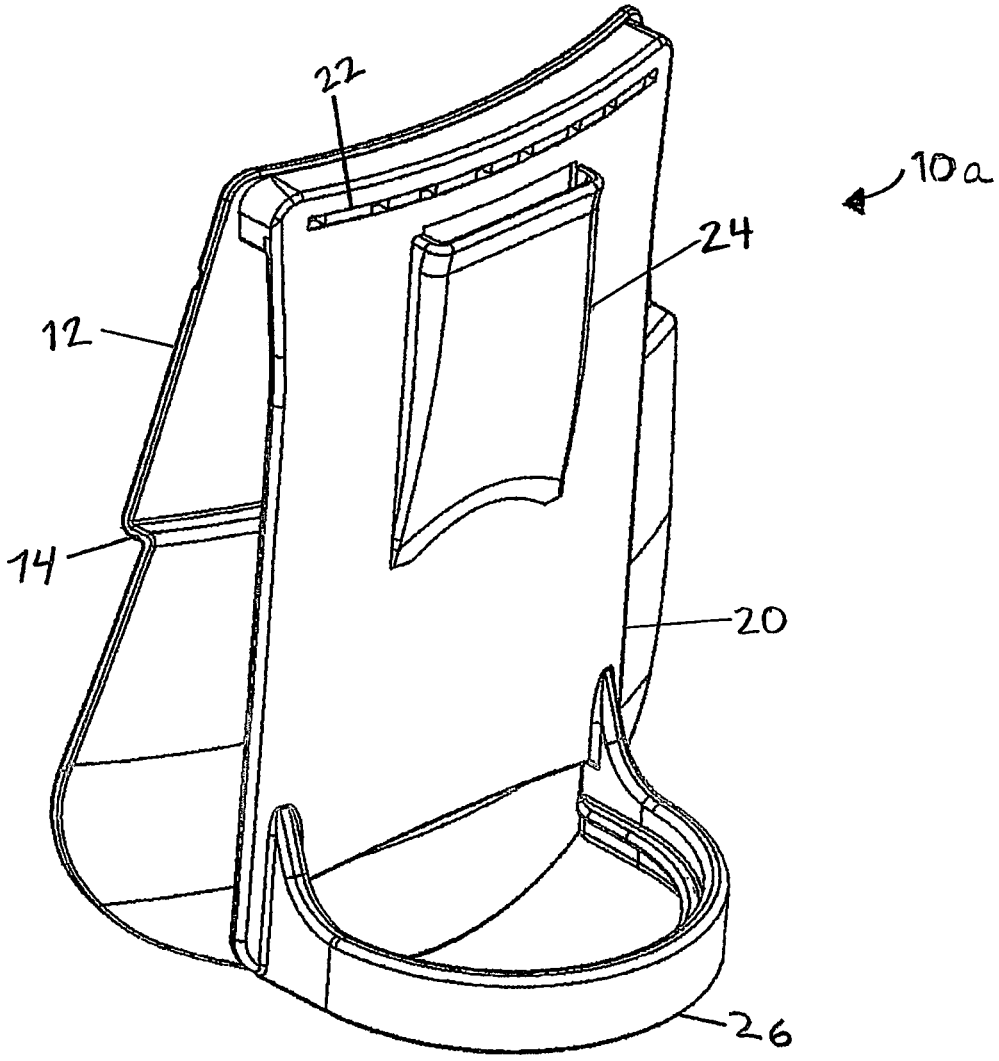
FIG. 2 is a perspective view of the front of a hammer and tape measure unit in accordance with the present invention.

Front section 20 may be provided with a variety of tool holder arrangements, such as the hammer and tape measure holder unit 10*a* shown in FIG. 2. Unit 10*a* is attached to a belt by sliding the user's belt between base 12 and front section 20 until the belt rests securely above step 14 and below line of attachment 22, within the space of channel 16. Unit 10*a* is shown with a tape measure holder 24 provided as a slot for insertion of a standard tape measure clip, and a semicircular strap 26 attached to front section 20 at its distal end for inserting the handle of a hammer, mallet or similarly shaped tool having a stock and head component.

Figure 3:
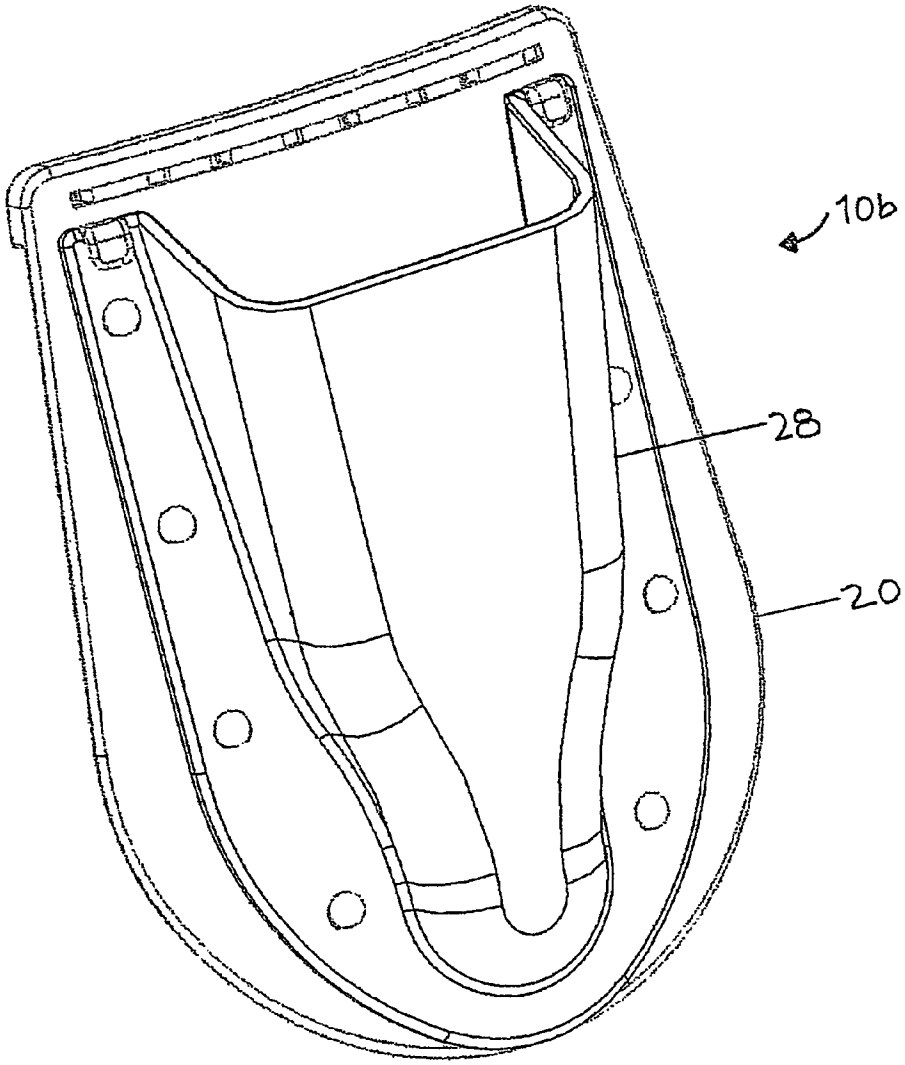
FIG. 3 is a perspective view of the front of a shears unit in accordance with the present invention.

FIG. 3 shows tool holder unit 10*b* designed for holding shears, scissors and similarly shaped tools, including pliers, wire strippers and the like. A generally shear-shaped pocket-like attachment 28 is formed on front section 20, and may be of one piece (as shown) or formed in strips or with holes (not shown). Optionally, pocket-like attachment 28 may be provided with at least one flexible flange interior to attachment 28 which helps to snag an inserted tool so as to prevent an inserted tool from falling out of attachment 28 upon movement of the user (not shown).

Figure 4:
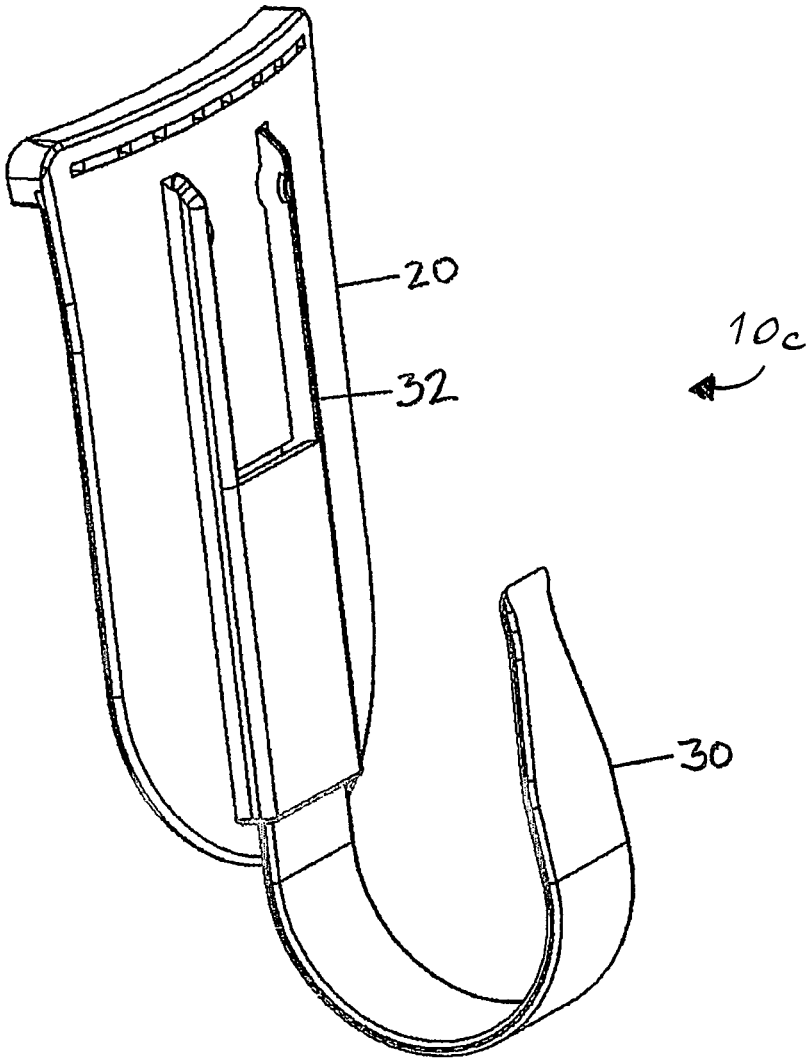
FIG. 4 is a perspective view of a hook unit in accordance with the present invention.

FIG. 4 shows tool holder unit 10*c* wherein front section 20 is adapted to accommodate hook 30 formed thereon. Hook 30 is appropriately sized for holding a cordless tool such as a cordless drill or the like. Hook 30 is attached to front section 20 by track 32, which provides an adjustment means for adjusting the position of a tool sitting at rest within tool holder unit 10*c* to comfortably match the leg height of a user.

Figure 5:
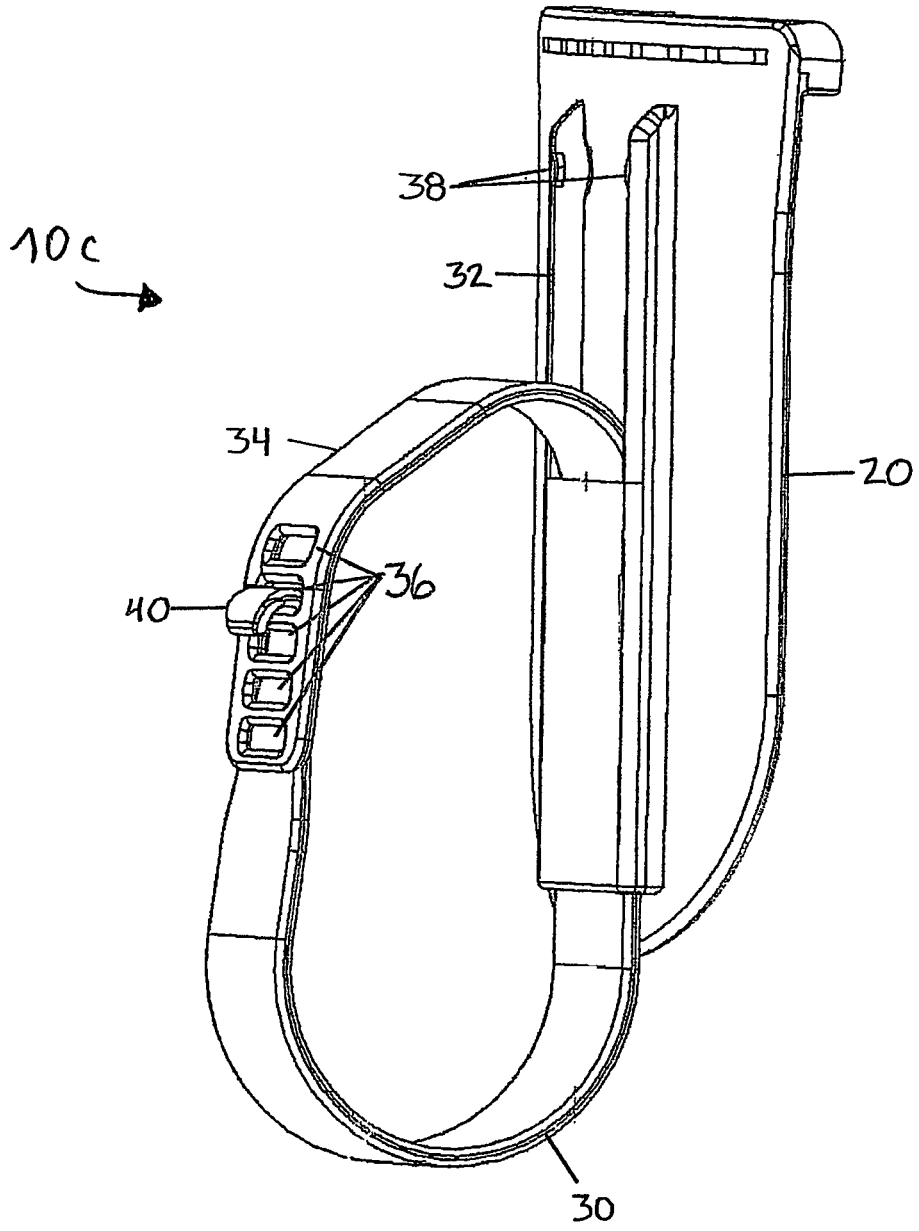
FIG. 5 is a perspective view of a hook and strap unit in accordance with the present invention.

As shown in FIG. 5, tool holder unit 10*c* may be provided with an optional flexible strap 34 for adjustable attachment to a modified hook 30 using strap holes 36. When not in use, strap 34 may be clipped into track 32 by securing it behind pins 38, so that strap 34 will not be in the way and inadvertently catch on anything. The tip of hook 30 is modified by the addition of a bend 40 for insertion through strap holes 36.

Figure 6:
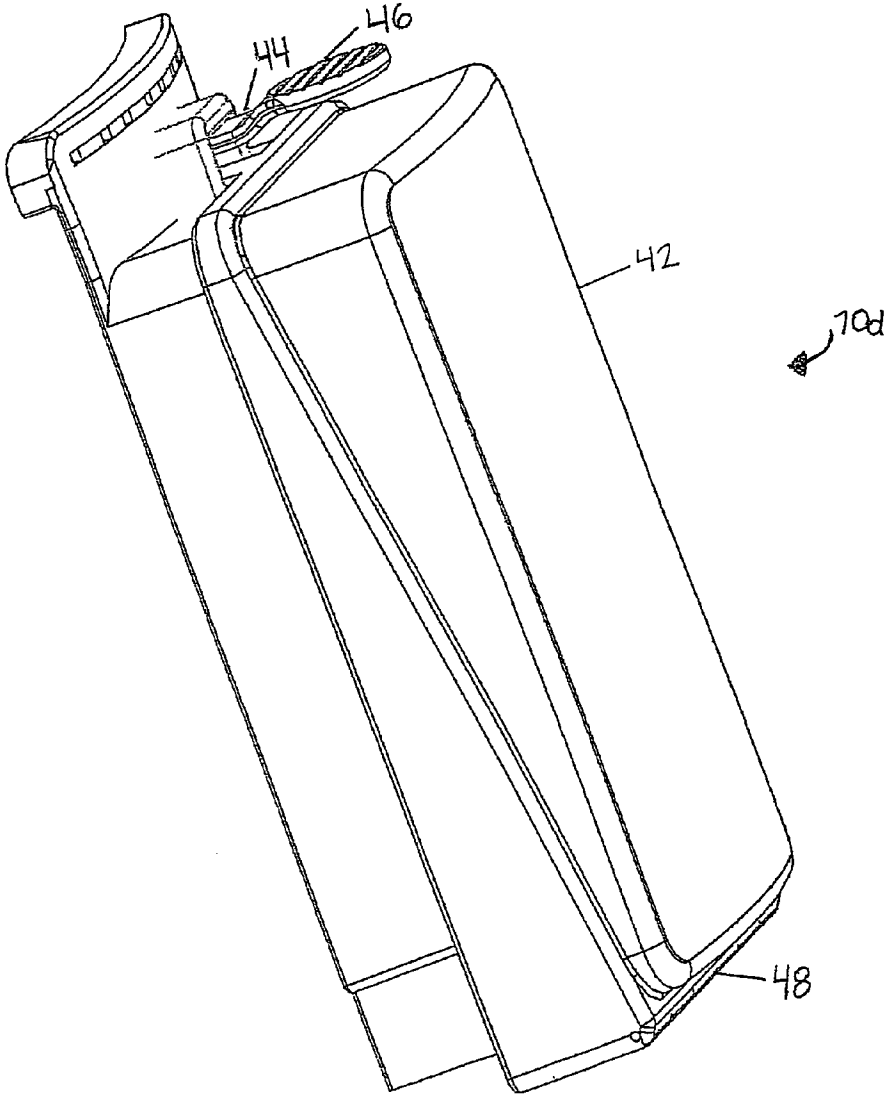
FIG. 6 is a perspective view of a closed storage container unit in accordance with the present invention.

In FIG. 6, there is shown tool holder unit 10*d* comprising a water-proof container 42 for storage of items which can be damaged by water, e.g., a cellular phone, a camera, and a PDA. This can be helpful both for the workman in a situation where rain or water lines are involved, and also in other water-threatening situations such as in close proximity to a body of water. The water-proof container 42 is provided with a secured latch 44 so as to prevent accidental opening. Opening is accomplished by means of press-tab 46 so that opening is a conscious motion.

Figure 7:
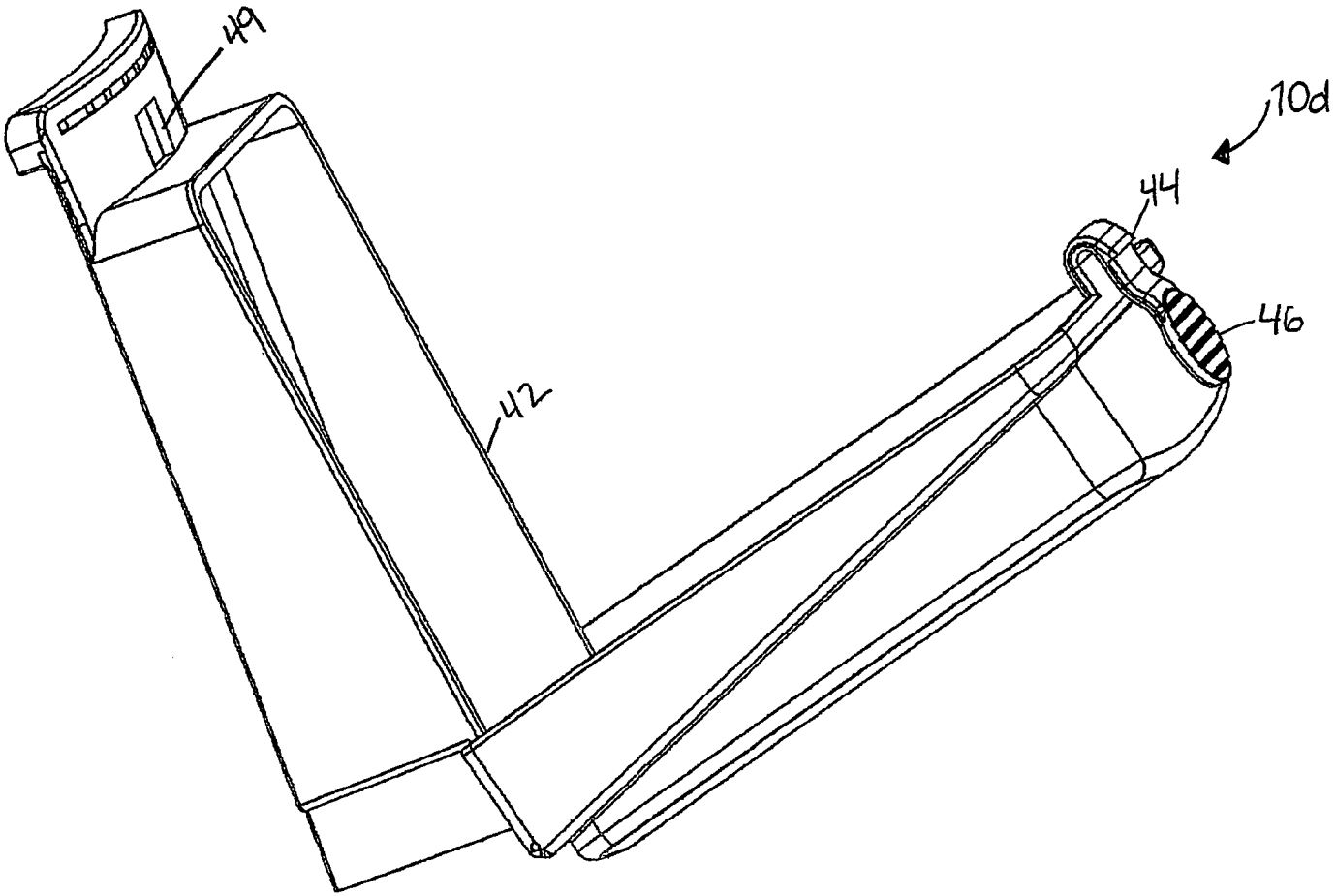
FIG. 7 is a perspective view of the storage container unit of FIG. 6 shown in an opened condition.

As shown in FIG. 7, the container opens on hinge 48 to an approximately 60° angle so as to prevent the contents of the container from accidentally spilling upon opening of the container. To re-close container 42, secured latch 44 is inserted into latch hole 49 in a clicking motion.

Figure 8:
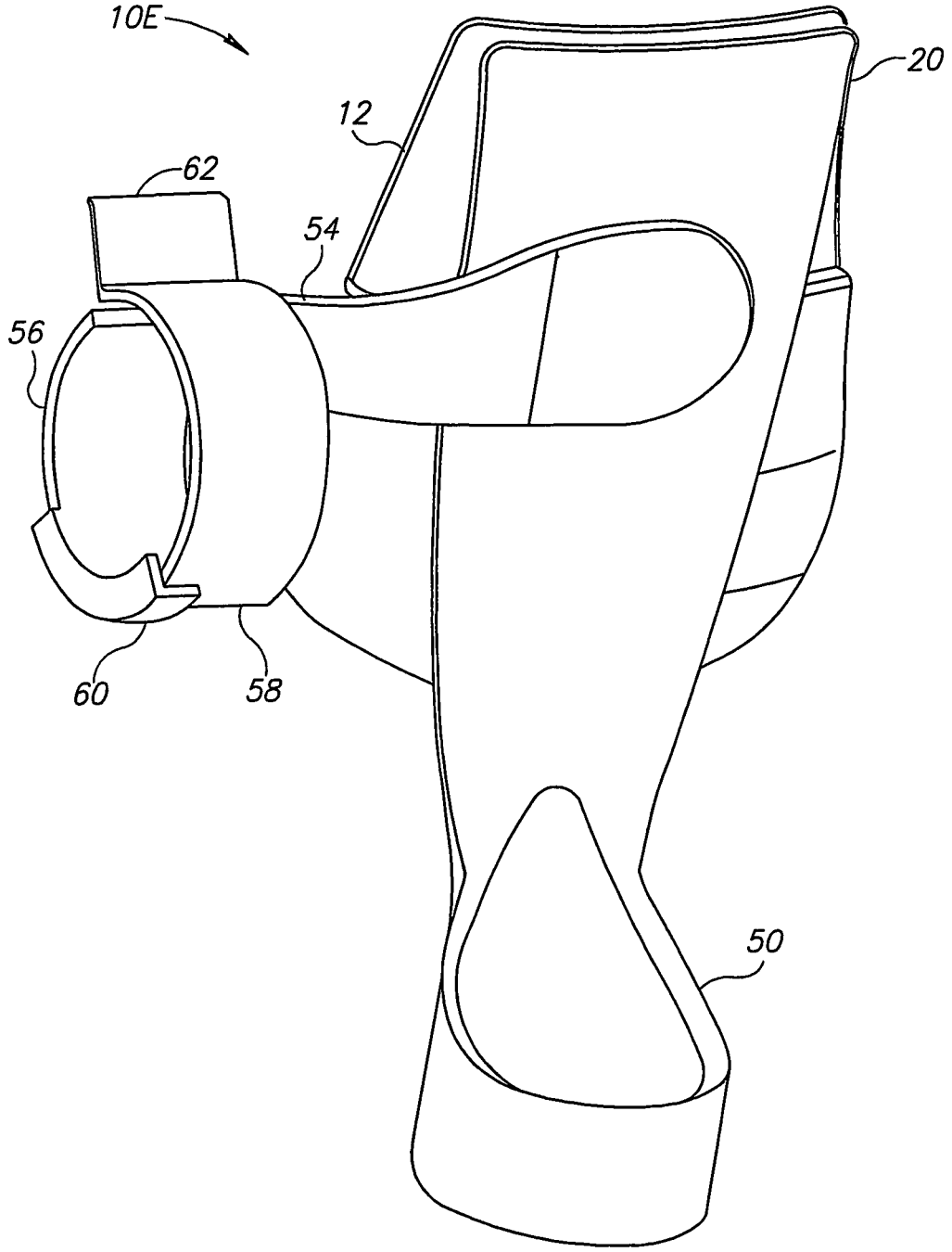
FIG. 8 is perspective view of the cuff embodiment of the cordless tool unit of the present invention.

FIG. 8 shows one of a variety of options for tool holder unit 10*e* for use with cordless hand-held tools. Front section 20 is formed with a lower-end extension having formed therein a loop 50 for insertion of an end of a cordless tool. Front section 20 is additionally formed with an attachment mechanism 52 for rotatable attachment to arm 54 such that when not in use, arm 54 may be extended downward along the length of front section 20 so as to be out of the way. Additionally, arm 54 may be provided with a cuff-shaped end, cuff 56, for supporting a handle (not shown) of the cordless tool. The handle may be secured into cuff 56 by a sliding mechanism 58, which retracts into track 60. Sliding mechanism 58 is provided with tab 62 for one-handed ease of opening and closing.

Alternatively, a flexible strap (not shown, see FIG. 5) is provided for securing the handle into cuff 56. The user may choose between an arm 54 with cuff 56 which is suitable for use by right- or left-handed users and attach the appropriate arm 54 to attachment mechanism 52 by any means as is known to those skilled in the art.

In an alternative embodiment (not shown) to tool holder unit 10*e*, arm 54 may be provided with an "S"-shaped end such that when arm 54 is rotated around rotatable attachment mechanism 52, the curves of the "S" provide support to the handle of the cordless tool in a configuration appropriate for either right or left-handed use.

In a further embodiment (not shown) of tool holder unit 10*e*, arm 54 is provided with a separate "U"-shaped end for slidable attachment by either extension of the "U" so as to provide either left or right-handed use. Arm 54 is then rotated in the desired direction. A flexible strap may be further attached for securing the handle of the cordless tool in place.

In yet another embodiment (not shown) of tool holder unit 10*e*, loop 50 is replaced by a pocket-like structure being attached part way such that there are slits at the upper edge of connection between the pocket and front section 20 on both the left and right sides of the pocket. These slits allow for the extension of the handle of a power tool to either side to provide either a left- or right-handed orientation.

Figure 9A:
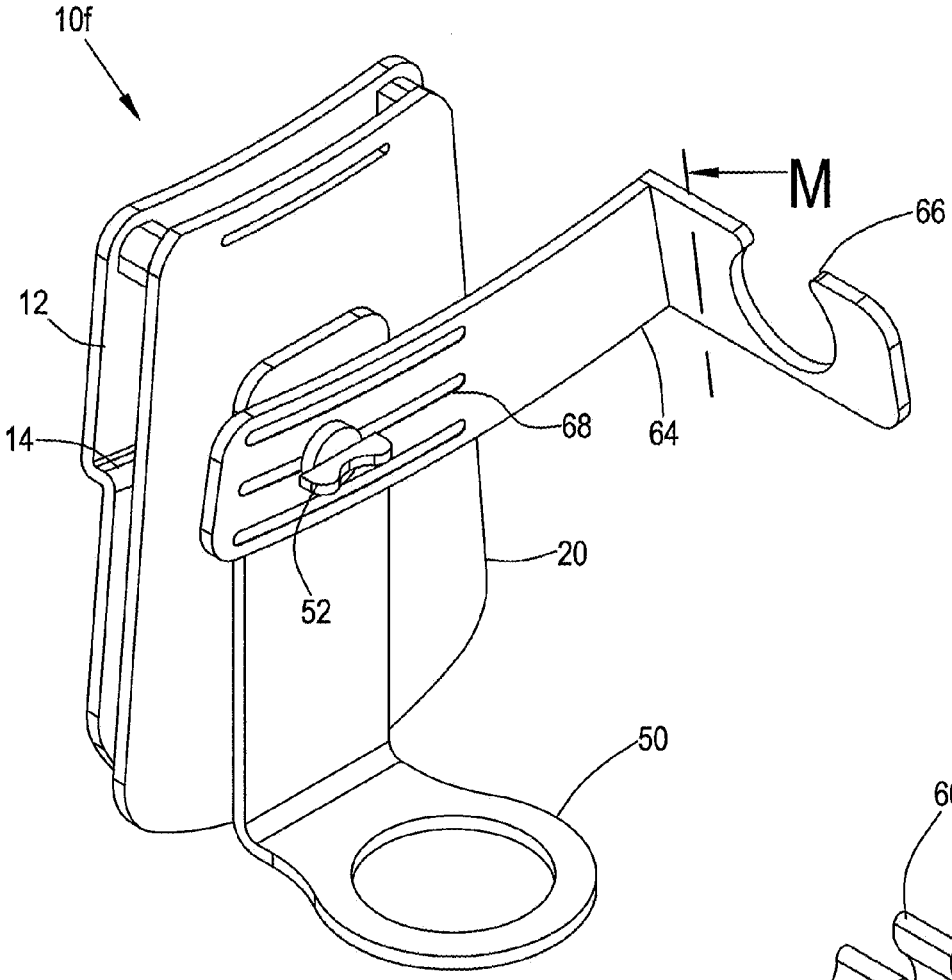
FIGS. 9A and 9B are, respectively, a perspective view and a detail, of another embodiment of the invention for holding cordless type hand tools.
Figure 9B:
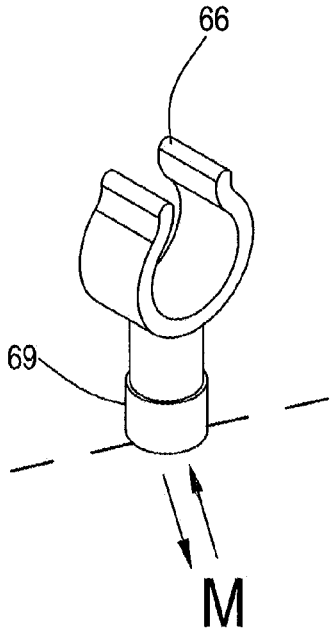

FIG. 9A is another embodiment of a tool holder unit 10*f* similar to that in FIG. 8, but a reversible attachable arm 64 replaces both the arm 54 and cuff 56 of FIG. 8. Arm 64 is provided with a slotted tool neck-rest 66 which accommodates a portable cordless electric tool (not shown) oriented such that the forward active part thereof is seated firmly in loop 50. The tool neck-rest 66 optionally is a separate, flexible, snap-on feature as shown in FIG. 9B connected to the end of arm 64 at a point marked M by an adapter 69 fitted to a matching connector (not shown) on arm 64 at point M. This allows for various neck sizes of tools to be supported in neck-rest 66. Arm 64 is attachable by rotatable attachment mechanism 52 and is connected in either a left- or right-handed orientation to tool holder unit 10*f* on front section 20.

In a preferred embodiment of the invention, arm 64 is fixed by insertion into slider rails 68, but other methods of attachment, as is well known by those skilled in the art, may be utilized. The mounting height of the reversibly attachable arm 64 is adjustable by aligning the slider rails 68 with higher or lower matching grooves formed on both sides of arm 64 for convenient left- and right-hand orientation of arm 64. Slider rails 68 can be adjusted for the width of a tool handle when arm 64 is rotated to a desired angle or horizontally. In manufacture, the ergonomically curved base 12 is formed together with front section 20 as one piece, but optionally, they may also be made as separate parts and assembled to form the tool holder unit 10*f*.

Figure 10A:
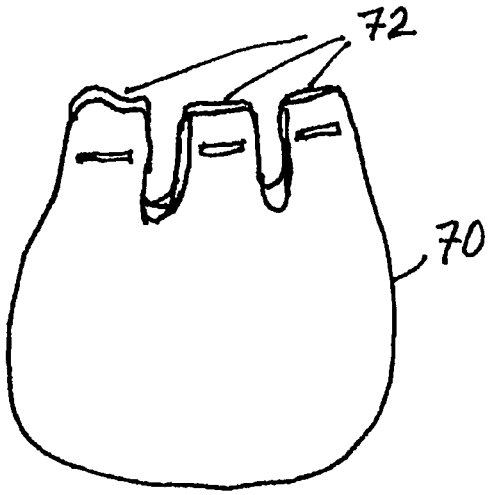
FIGS. 10A, 10B, and 10C are general views of variations on a further embodiment of the invention.

FIG. 10A is a view of an alternate embodiment of the invention. Base 70 is a single body section with finger-like extensions 72 which are spaced-apart to accommodate wider tool holder units as well as wider detachable pockets/pouches for small tools and/or accessories and parts.

Figure 10B:
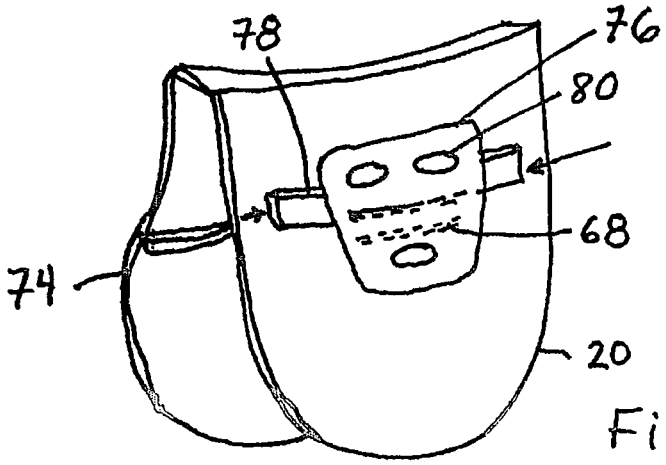

FIG. 10B is yet another embodiment of the invention illustrating a base 74 formed, in a preferred embodiment thereof, as a single piece together with a docking and locking flap 76 mounted on front section 20. In the embodiment shown, flap 76 is provided with a quick-release mechanism 78, such as a spring-release mechanism operated by squeezing the tabs (marked by arrows), which operates a connecting means 80, such as a series of oval-shaped perforations as illustrated by way of example. A cordless, hand-held, electric tool, as well as part-pouches containing small tools and/or parts are attached to connecting means 80 utilizing matching protuberances formed on an attaching surface of a pouch or tool holder unit. The quick-release mechanism 78 locks them into place and holds them securely.

Figure 10C:
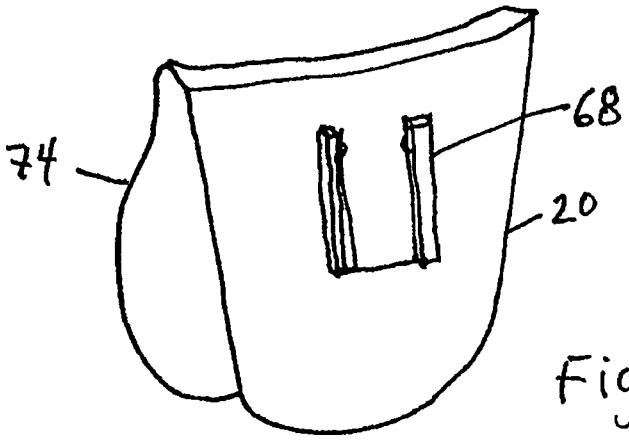

FIG. 10C is a further embodiment of the invention utilizing vertically disposed slider rails 68 as heretofore described. The slider rails 68 also enable quick attachment of various-sized hand tools to front section 20 of a tool holder unit in a manner similar to that of the connection of hook 30 as in FIG. 4. The slider rails 68 can be formed together with front section 20, or alternatively, made as separate parts to be joined after manufacture. It should be noted that the parts comprising tool holder units in general are made of any suitable, semi-rigid material, such as polymer plastic, heavy-duty rubber, leather, and the like, as is known to those skilled in the art, but in a preferred embodiment of the invention, are injection-molded plastic.

Figure 11A:
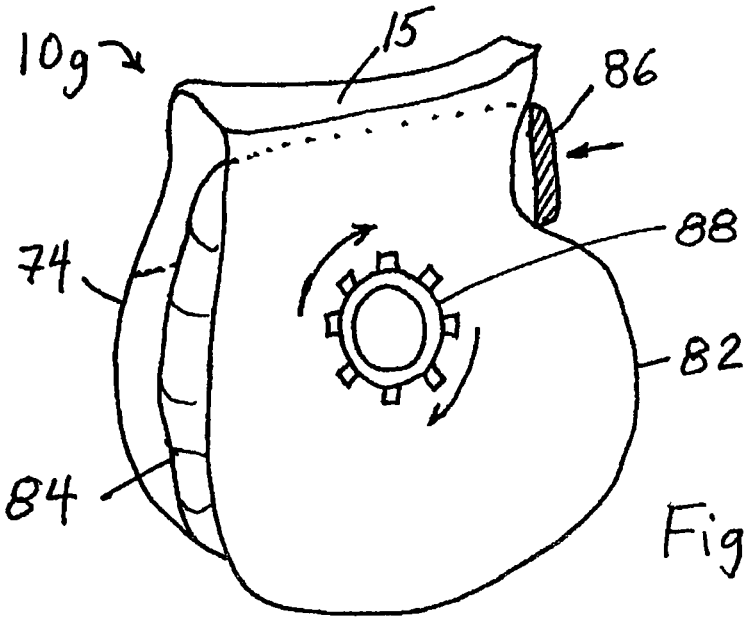
FIGS. 11A and 11B are, respectively, a general view and a detail, of an embodiment of the invention for holding heavy hand-tools mounted on stocks.
Figure 11B:
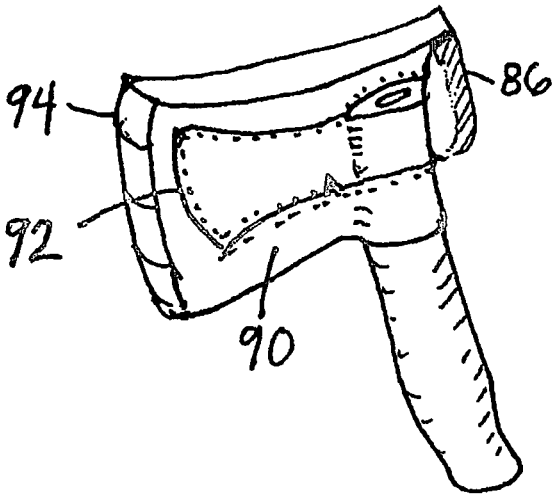

FIGS. 11A and 11B are views of yet another embodiment of the invention. In FIG. 11A is shown an ergonomically-shaped base 74 of a tool holding unit 10*g* shaped to fit the body of a user. A front section 82 shaped as a flap is connected at an upper section 15 to base 74. The middle section 84 formed between base 74 and front section 82 is designed to be sufficiently wide so as to accommodate the head of a heavy, hand tool mounted on a stock, such as a hatchet head 92, together with a protective blade sheath 94 which safely holds the sharp hatchet head 92 in the plenum 90, as shown in FIG. 11B. Note that the stock of the tool extends outside the blade sheath 94, but because it is short, it is not restrained in a loop or strap as in prior embodiments heretofore described, although this is optional. The hatchet head 92 is inserted and then locked into the middle section 84 by depressing a safety, push-button 86 which pops out to retain the inserted blade sheath 94 and hatchet head 92. To release the tool, push-button 86 must be depressed once again. A ratchet mechanism 88 on the outside face of front section 82 provides for rotating the whole middle section 84 a few degrees of arc in order to remove the tool stored therein at a safe-removal angle in relation to the body of a user. Push-button 86 provides a second level of safety protection in removal of sharp tools.

The above list is only a partial list of the possible tool holder units which could be described based on the inventive concept of a tool holder unit comprised of an ergonomic base attached at its top end to an ergonomic front section, the ergonomic base having means to secure a user's belt in place to prevent displacement.

Having described the invention with regard to certain specific embodiments thereof, it is to be understood that the description is not meant as a limitation, since further modifications will now suggest themselves to those skilled in the art, and it is intended to cover such modifications as fall within the scope of the appended claims.

The invention claimed is:

1. A tool holder unit for attachment to a user's belt, said tool holder unit comprising:

an ergonomically-shaped base;

an ergonomically-shaped front section attached at its top end to said ergonomically-shaped base, said ergonomically-shaped front section having means for insertion of at least one of a tool and tool accessories, wherein said means for insertion of at least one of a tool and tool accessories comprises a rotatably attachable arm rotatable to a desired angle in the same plane as that of said front section and at least one structure selected from the group:

a. a pocket;

b. a semi-circular strap;

c. a scissors-like pouch;

d. a hook; and e. a cuff and loop, wherein said rotatably attachable arm comprises a reversible arm to accommodate at least one of a left-and right-handed use, wherein said reversible arm is attached to said front section by a connection means comprising slider rails for enabling width adjustment at said desired angle to accommodate a handle of said tool, and a securing means for securing a user's belt between said ergonomically-shaped base and said ergonomically-shaped front section, such that said tool holder unit does not become displaced from the user's belt due to body motion by the user.

2. The tool holder unit of claim 1 wherein said securing means comprises a step formed in said ergonomically-shaped base for preventing displacement of said tool holder unit from the belt of a user.

3. The tool holder unit of claim 2 wherein said securing means comprises a channel formed between said ergonomically-shaped base and said ergonomically-shaped front piece to accommodate the belt of a user, said belt being fixed therein without necessitating removal from the body of a user.

4. The tool holder unit of claim 2 wherein said step comprises an offset fold formed in the plane of the material of said ergonomically-shaped base such that when subjected to upward pressure, said base is retained in a fixed position relative to the body motion of a user.

* * * * *